US012571381B2

(12) United States Patent
Hu et al.

(10) Patent No.: US 12,571,381 B2
(45) Date of Patent: Mar. 10, 2026

(54) CONSTANT FLOW PUMP

(71) Applicant: DONGGUAN ZHONGNENG PRECISION MACHINERY CO., LTD, Dongguan (CN)

(72) Inventors: Wen Hu, Dongguan (CN); Hao Dai, Dongguan (CN)

(73) Assignee: DONGGUAN ZHONGNENG PRECISION MACHINERY CO., LTD, Dongguan (CN)

( * ) Notice: Subject to any disclaimer, the term of this patent is extended or adjusted under 35 U.S.C. 154(b) by 0 days.

(21) Appl. No.: 18/956,436

(22) Filed: Nov. 22, 2024

(65) Prior Publication Data

US 2026/0063115 A1 Mar. 5, 2026

(30) Foreign Application Priority Data

Sep. 29, 2024 (CN) ..... 202411227412.9

(51) Int. Cl.
*F04B 9/04* (2006.01)
*F04B 11/00* (2006.01)
*F04B 17/03* (2006.01)

(52) U.S. Cl.
CPC ..... *F04B 9/042* (2013.01); *F04B 9/045* (2013.01); *F04B 11/005* (2013.01); *F04B 17/03* (2013.01)

(58) Field of Classification Search
CPC ..... F04B 9/042; F04B 9/045; F04B 9/025; F04B 9/02; F04B 11/005; F04B 1/00; F04B 13/00; F04B 15/00; F04B 17/003; F04B 17/00; F04B 17/03; F04B 53/22
See application file for complete search history.

(56) References Cited

U.S. PATENT DOCUMENTS 4,172,695 A * 10/1979 Uesugi ..... F04D 13/06 415/127
5,616,013 A * 4/1997 Kobayashi ..... F04D 29/669 415/182.1
5,857,841 A * 1/1999 Kobayashi ..... F04D 13/086 417/423.5
5,888,053 A * 3/1999 Kobayashi ..... F04D 29/445 417/244

(Continued)

FOREIGN PATENT DOCUMENTS

CN 116335910 A * 6/2023 ..... F04B 13/00

*Primary Examiner* — Dapinder Singh
(74) *Attorney, Agent, or Firm* — HOWARD M. COHN and Associates, LLC

(57) ABSTRACT

Disclosed is a constant flow pump, including a constant flow pump case. A motor support base is fixedly mounted at a top of the constant flow pump case, A drive motor is fixedly mounted at a top of the motor support base. An output end of the drive motor penetrates through the motor support base. A coupling is arranged in the motor support base. A linkage rod is driven by an adjusting hand wheel to enable a connecting plate to move internally. A limiting bump is separated from a slot. A butting seat can be extracted. A rotating shaft and an eccentric cam are detached rapidly. During mounting, the butting seat with a new component is inserted, the limiting bump is in contact with the slot, the adjusting hand wheel is loosened, and a limiting spring enables the bump to be clamped into the slot to accomplish clamping.

10 Claims, 11 Drawing Sheets

(56) References Cited

U.S. PATENT DOCUMENTS

| | | | | |
|---|---|---|---|---|
| 6,692,205 | B2 * | 2/2004 | Moroi | F04C 23/008 417/410.5 |
| 8,668,466 | B2 * | 3/2014 | Allen | F04B 1/07 74/579 E |
| 11,415,119 | B2 * | 8/2022 | Hughes | F04B 39/10 |
| 11,773,839 | B2 * | 10/2023 | Van Stell | F04B 43/0009 417/477.1 |
| 12,392,331 | B2 * | 8/2025 | Hughes | F04B 1/04 |
| 2014/0147294 | A1 * | 5/2014 | Fargo | F04C 28/24 417/410.5 |
| 2018/0045187 | A1 * | 2/2018 | Nagel | F04B 9/045 |
| 2021/0180609 | A1 * | 6/2021 | Geue | H02K 1/32 |
| 2022/0390036 | A1 * | 12/2022 | Ledet | F04D 25/06 |
| 2023/0039274 | A1 * | 2/2023 | Hughes | F04B 1/00 |
| 2023/0407856 | A1 * | 12/2023 | Bolt | F04B 1/053 |

* cited by examiner

CONSTANT FLOW PUMP

TECHNICAL FIELD

The present disclosure relates to the technical field of constant flow pumps, and in particular to a constant flow pump.

BACKGROUND

With the rapid development of modern industry and scientific research at present, the demand on fluid conveying equipment is showing an increasing trend day by day, especially in the fields with strict requirements on flow precise control, such as chemical industry, pharmaceuticals, laboratory analysis work, and application of medical equipment, this demand appears to be particularly urgent. Although conventional fluid conveying equipment such as centrifugal pumps and diaphragm pumps has good performance in part of application scenarios, they have certain limitations in many aspects. In terms of providing a constant flow, the conventional equipment can hardly remain a stable constant flow all the time. In terms of anti-pollution capacity, its performance is always less than satisfactory. In terms of maintenance simplicity, it also has many inconveniences. As emerging equipment in the fluid conveying field, constant flow pumps attract much attention as they have characteristics of providing stable and adjustable flows. They often strongly guarantee the consistency of the flow by way of mechanical or electronic control. Even in a complex situation where the pressure fluctuates or the fluid viscosity changes, they still can maintain excellent performance.

However, the existing constant flow pump technique still has space to be enhanced and improved in some aspects. For example, a part of constant flow pumps will result in a wear problem after long-term operation, so that the flow precision is somewhat reduced. It is complex and difficult to operate some constant flow pumps in assembling and debugging processes. Besides, control systems of another part of constant flow pumps seems to be quite complex with relatively high costs, which is harmful to the wide popularization and promotion of the constant flow pumps in those applications that are more sensitive to cost. For example, in a production flow of fine chemical engineering, subtle changes in the flow may affect the quality and output of products. The unstable flow of conventional pumps will bring a great deal of trouble. In terms of manufacturing some small medical equipment, the complex control systems of the constant flow pumps with high costs will increase the costs of the products, which affect the market competitiveness of the constant flow pumps.

SUMMARY

An object of the present disclosure is to provide a constant flow pump to solve the problems proposed in the background art.

In order to achieve the above object, the present disclosure provides a constant flow pump, including a constant flow pump case, where a motor support base is fixedly mounted at a top of the constant flow pump case, a drive motor is fixedly mounted at a top of the motor support base, an output end of the drive motor penetrates through the motor support base, a coupling is arranged in the motor support base, a cam shaft mechanism is movably mounted in the constant flow pump case, a top of the cam shaft mechanism is fixedly connected to a bottom output end of the drive motor through the coupling, a piston mechanism is movably mounted on an outer side of the cam shaft mechanism, the piston mechanism coats the outer side of the cam shaft mechanism, a bearing is externally embedded onto each of the eccentric cams of the cam shaft mechanism and the cam shaft mechanism is connected to one or more piston mechanisms to achieve one or more liquid injections simultaneously, the piston mechanism is in transmission connection to the cam shaft mechanism, one end of the piston mechanism penetrates through the constant flow pump case, and a liquid inlet and outlet mechanism is fixedly mounted on a side of the constant flow pump case away from the side penetrated by the piston mechanism.

Further, the liquid inlet and outlet mechanism includes a liquid storage tank, the liquid storage tank is fixedly mounted on the side of the constant flow pump case away from the side penetrated by the piston mechanism, one-way valves are fixedly mounted at an equal or unequal interval in the liquid storage tank, a busbar is fixedly mounted on an outer side of the liquid storage tank, a liquid inlet pipe is fixedly mounted at an upper end of an outer side of the busbar, a liquid outlet pipe is fixedly mounted at a lower end of the outer side of the busbar, outer ends of the liquid inlet pipe and the liquid outlet pipe both are fixedly connected to self-closed rapid hydraulic joints, an output end of the liquid inlet pipe communicates with an input end of the liquid storage tank through the one-way valves, and the liquid outlet pipe communicates with an output end of the liquid storage tank through the one-way valves.

Further, permanent seats are fixedly mounted at both ends of front sides of the top and a bottom of the constant flow pump case, and bridge handrails are articulated in the permanent seats.

Further, a first overhaul sealed door is mounted on a front surface of the constant flow pump case through bolts, and a second overhaul sealed door is mounted on a front surface of the motor support base through bolts.

Further, the cam shaft mechanism includes mounting seats and a rotating shaft, the mounting seats are provided in two groups, one of the mounting seats is rotationally connected to a middle of the top in the constant flow pump case, the mounting seat located at a top is fixedly connected to the output end of the drive motor through the coupling, the mounting seat located at a bottom is rotationally connected to a bottom in the constant flow pump case, clamping pieces are fixedly mounted at both ends of the rotating shaft, the rotating shaft is mounted between inner sides of the mounting seat through the clamping pieces, eccentric cams are fixedly mounted at an equal interval on an outer surface of the rotating shaft, and the piston mechanism is sleeved on an outer side of each of the eccentric cams, each of the eccentric cams is embedded onto the bearing, and the bearing is in contact with the piston mechanism.

Further, each of the clamping pieces includes fixed arms and a butting seat, the fixed arms are fixedly mounted on both sides of a top and a bottom of the rotating shaft, the butting seat is fixedly mounted on an inner side of each of the mounting seats, a cavity is formed on an inner side of the butting seat, limiting springs are fixedly connected at an equal interval on both sides in the cavity, a limiting bump is fixedly connected to an outer side of each of the limiting springs, an outer end of the limiting bump penetrates through the butting seat, a slot is formed in an outer end of each of the fixed arms, the limiting bump is inserted into the slot, and an adjusting assembly is movably mounted on a front surface of the butting seat.

Further, the adjusting assembly comprises a connecting plate and an adjusting plate, the adjusting plate is rotationally connected to a middle of the front surface of the butting seat, the connecting plate is fixedly mounted at an inner end of a front surface of the limiting bump, a front end of the connecting plate is rotationally connected to an articulating ball, articulating grooves are formed in both ends of the adjusting plate, a linkage rod is rotationally connected to an inner side of each of the articulating grooves, an outer end of the linkage rod is fixedly connected to the articulating ball, and an outer end of the linkage rod is articulated with the connecting plate through the articulating ball.

Further, an adjusting hand wheel is fixedly mounted in a middle of a front surface of the adjusting plate, handrail rods are fixedly mounted at an equal interval on an outer side of the adjusting hand wheel, ball bearings are movably mounted at the top and the bottom in the constant flow pump case, and an inner side of each of the ball bearings is fixedly connected to each of the mounting seats.

Further, the piston mechanism comprises pump cores and piston frames, the piston frames are arranged at an equal interval in the constant flow pump case, the piston frames are sleeved on outer sides of eccentric cams on outer surface of the rotating shaft, a piston cylinder is mounted on a side, close to a liquid storage tank, of each of the piston frames through bolts, the pump cores are fixedly mounted at an equal interval in the liquid storage tank, an outer side of each of the pump cores communicates with each of the one-way valves, an end of the piston cylinder is inserted into each of the pump cores, and the piston cylinder is used for driving each of the pump cores.

Further, a guiding shaft is mounted on a side, away from the piston cylinder, of each of the piston frames through bolts, and an end of the guiding shaft penetrates through the constant flow pump case.

Compared with the prior art, the present disclosure has the following beneficial effects:

First, in the present disclosure, the drive motor matches with the cam shaft mechanism, and the drive motor is started to enable the rotating shaft to drive the eccentric cams to rotate so as to promote the piston frames to reciprocate horizontally in the constant flow pump case; the guiding shaft assists to enable the piston cylinder to drive the pump cores to operate so as to form one-way circulation through the one-way valves; a liquid is discharged from the liquid outlet pipe as the liquid inlet pipe, the liquid storage tank, the piston mechanism, and the valve core match with each other; the assembly error is reduced by the integral structure of the rotating shaft and the eccentric cams, so that the precision is higher, the assembling and debugging difficulty is reduced, the stability and the liquid injection precision are improved, and the wear is reduced; the cam shaft is connected to a plurality of piston mechanisms to inject the liquid many times; the one-way valves of the liquid inlet pipe and the liquid outlet pipe and a bus board reduce pulsation, so that the liquid injection precision is improved; for example, in injection of a high precision chemical reagent, accurate addition can be ensured, so that an experimental result is prevented from being affected by flow fluctuation; moreover, the constant flow pump can perform liquid injections two times and four times simultaneously through the arrayed piston mechanisms and the liquid inlet and outlet mechanism during application and is not limited to the above two types;

Second, in the present disclosure, by arranging the clamping pieces, it is needed to overhaul the cam shaft mechanism during the application of the apparatus. The guiding shaft and piston cylinder on both sides of each of the piston frames can be detached, the adjusting hand wheel is manually twisted to drive the linkage rod to enable the connecting plate to move internally, and the limiting bump is separated from the slot, so that the butting seat can be extracted, and the rotating shaft and the eccentric cams are detached rapidly. During mounting, the butting seat with a new component is inserted, the limiting bump is in contact with the slot, the adjusting hand wheel is loosened, and the limiting spring enables the bump to be clamped into the slot to accomplish clamping. Based on the design, the rotating shaft and the eccentric cam can be dismounted rapidly. During overhauling, it is not needed to dismount a whole structure of the drive motor, so that the design is convenient and flexible and improves the assembling, using, and maintaining convenience. For example, during emergency overhauling of faults of the constant flow pump in industrial production, the maintenance time can be greatly shortened and the production downtime loss can be greatly reduced.

In the figures: 1, constant flow pump case; 2, motor support base; 3, drive motor; 4, coupling; 5, cam shaft mechanism; 51, mounting seat; 52, rotating shaft; 53, clamping piece; 531, butting seat; 532, cavity; 533, limiting bump; 534, slot; 535, adjusting assembly; 5351, connecting plate; 5352, adjusting plate; 5353, articulating ball; 5354, articulating groove; 5355, linkage rod; 5356, adjusting hand wheel; 5357, handrail rod; 54, eccentric cam; 55, ball bearing; 56, fixed arm; 58, limiting spring; 6, piston mechanism; 61, pump core; 62, piston frame; 63, piston cylinder; 64, guiding shaft; 7, liquid inlet and outlet mechanism; 71, liquid storage tank; 72, one-way valve; 73, busbar; 74, liquid inlet pipe; 75, liquid outlet pipe; 76, self-closed rapid hydraulic joint; 8, permanent seat; 9, bridge handrail; 10, first overhaul sealed door; and 11, second overhaul sealed door.

DETAILED DESCRIPTION

Figure 1:
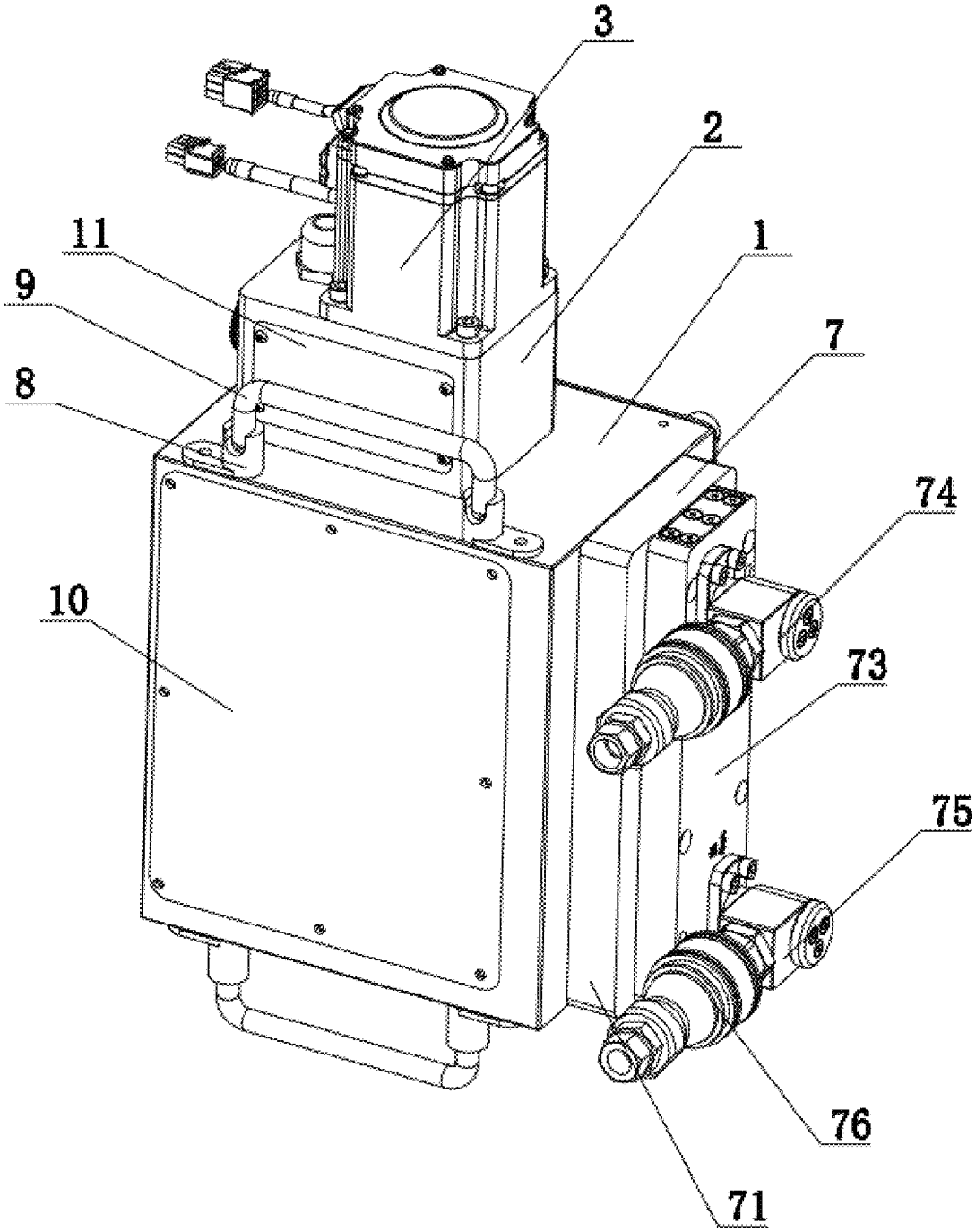
FIG. 1 is an overall structural schematic diagram of the present disclosure.
Figure 2:
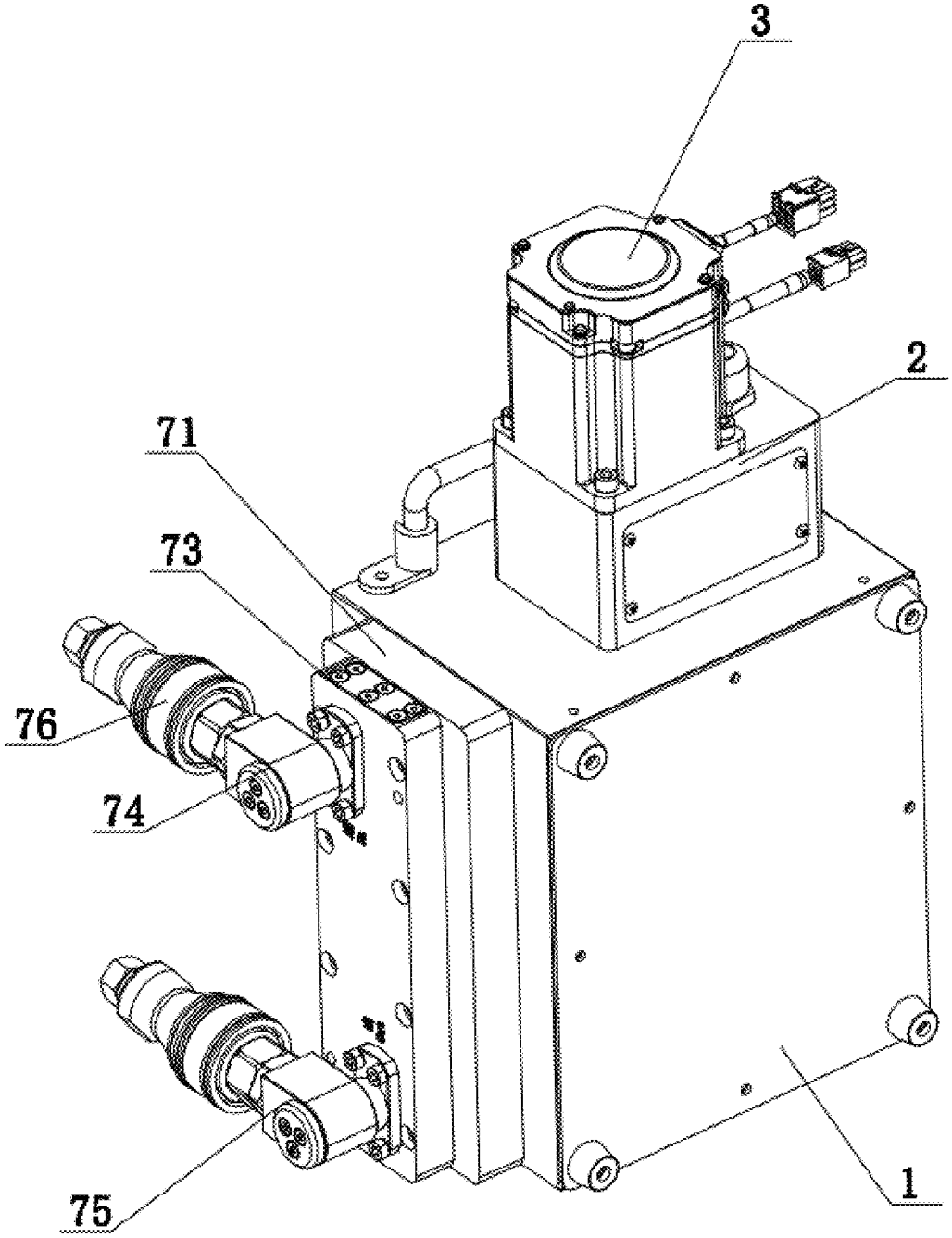
FIG. 2 is a rear view structural schematic diagram in the present disclosure.
Figure 3:
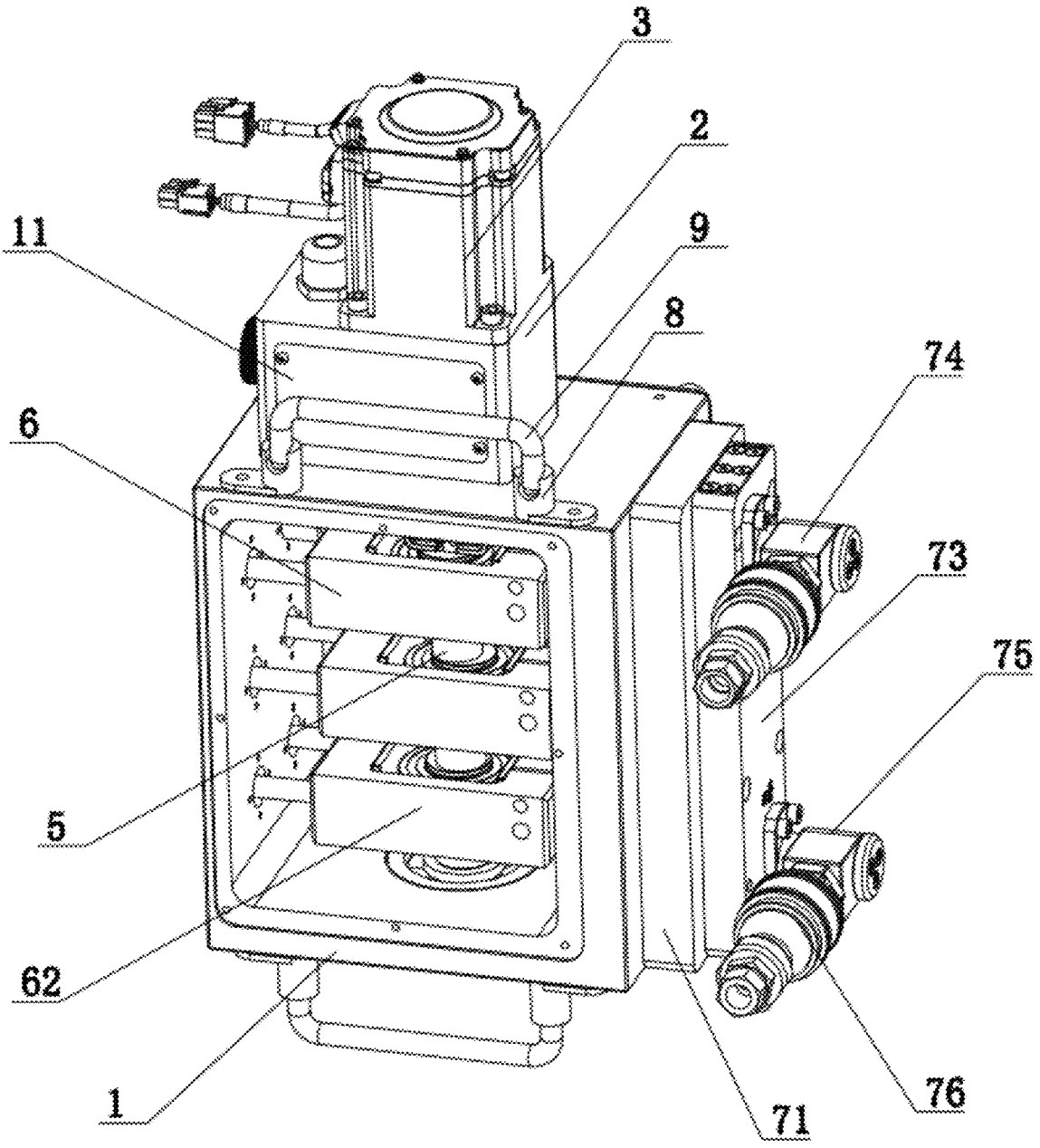
FIG. 3 is an internal schematic structural diagram of a constant flow pump case in the present disclosure.
Figure 4:
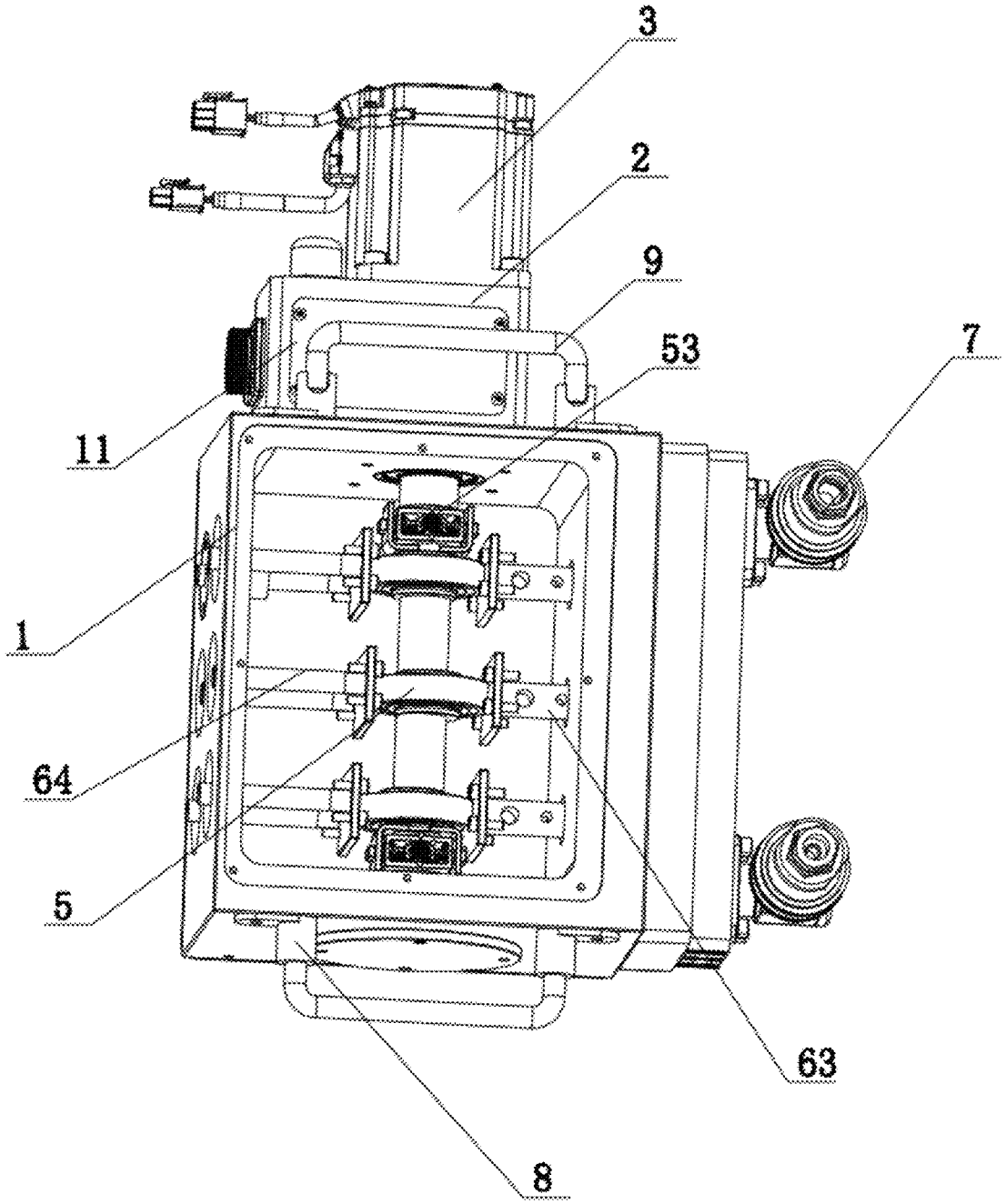
FIG. 4 is a schematic structural diagram of the constant flow pump case and a cam shaft mechanism in the present disclosure.
Figure 5:
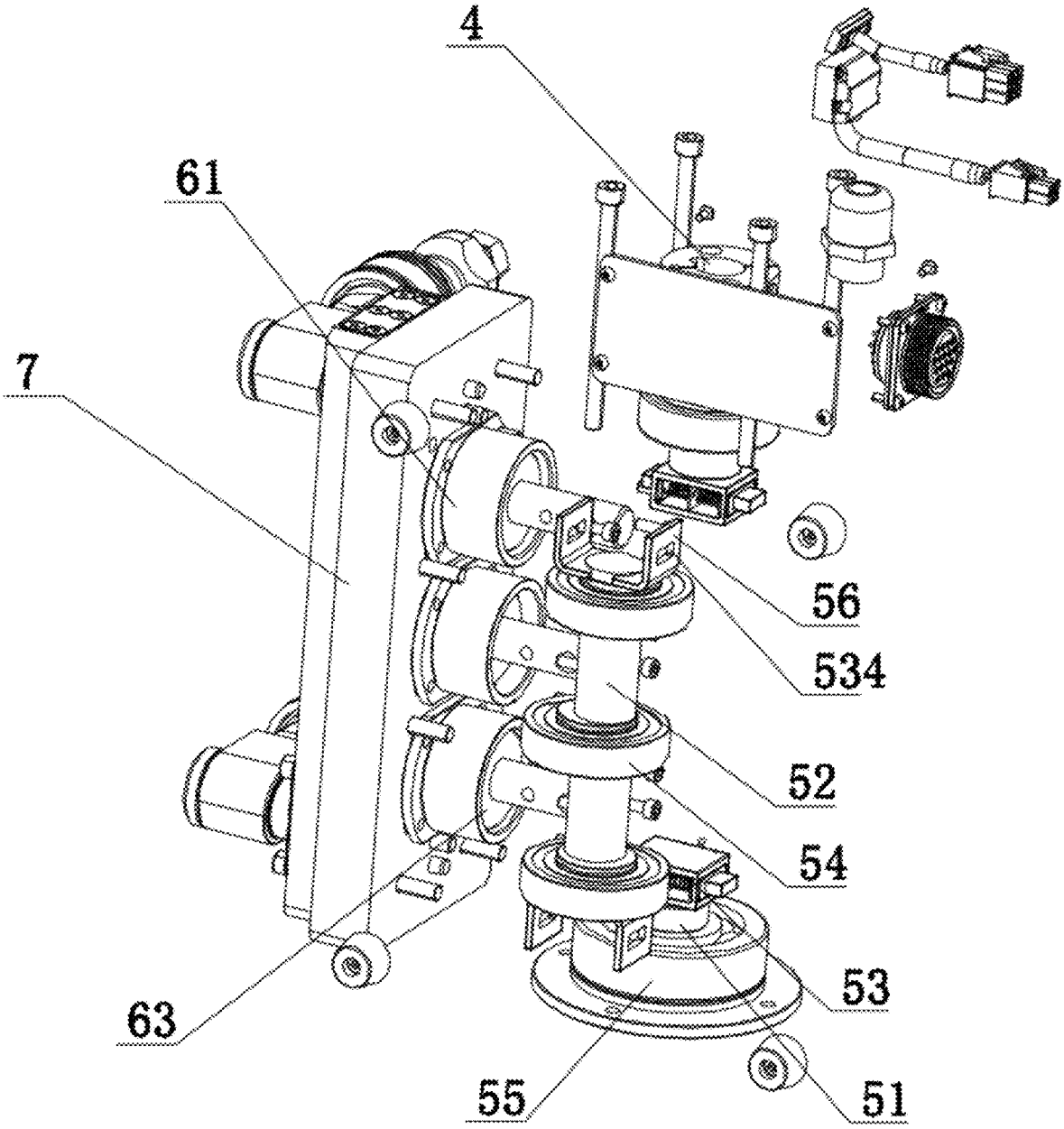
FIG. 5 is a rear view structural schematic diagram of the cam shaft mechanism in a split state in the present disclosure.
Figure 6:
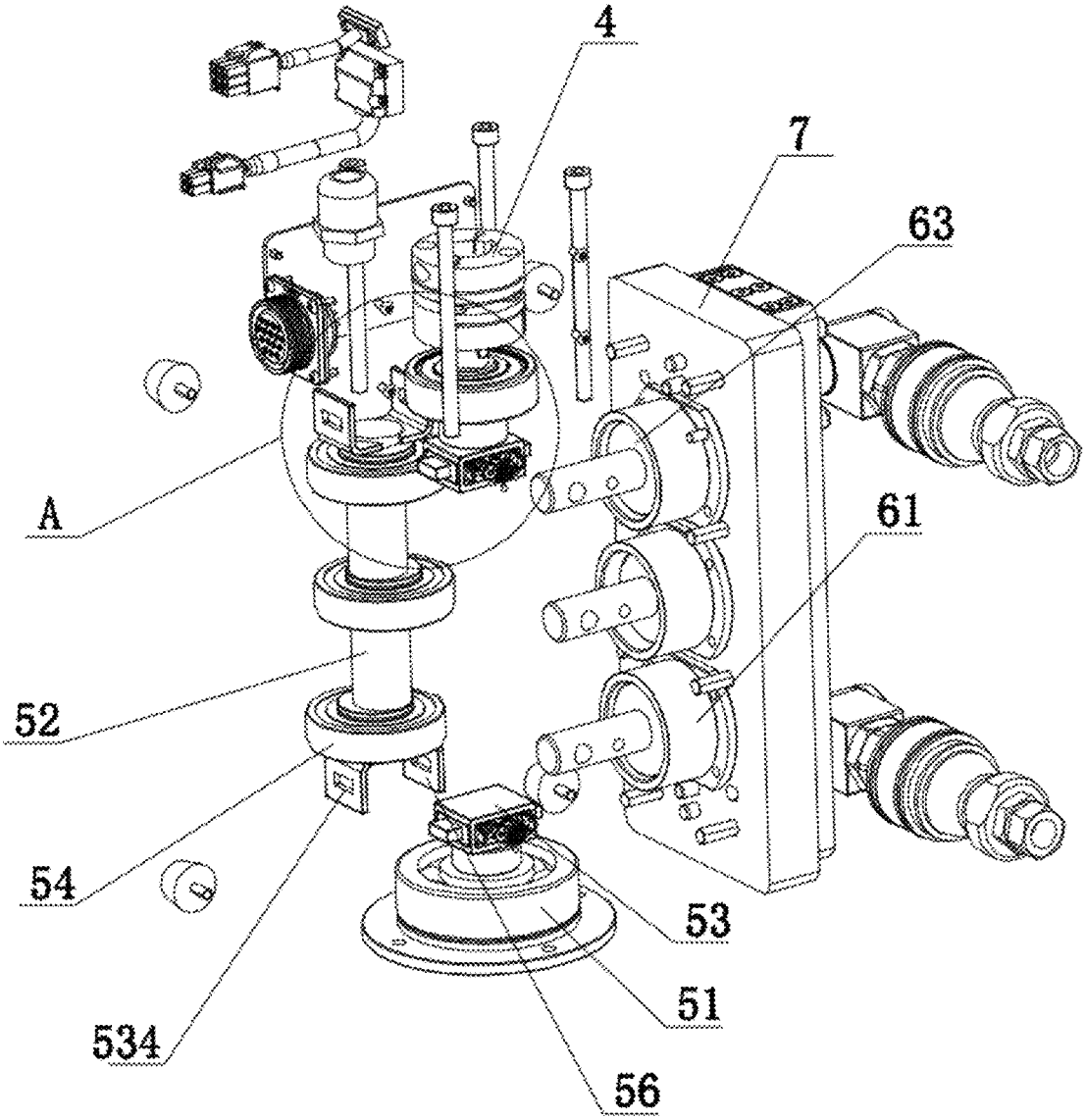
FIG. 6 is a front view structural schematic diagram of the cam shaft mechanism in the split state in the present disclosure.
Figure 7:
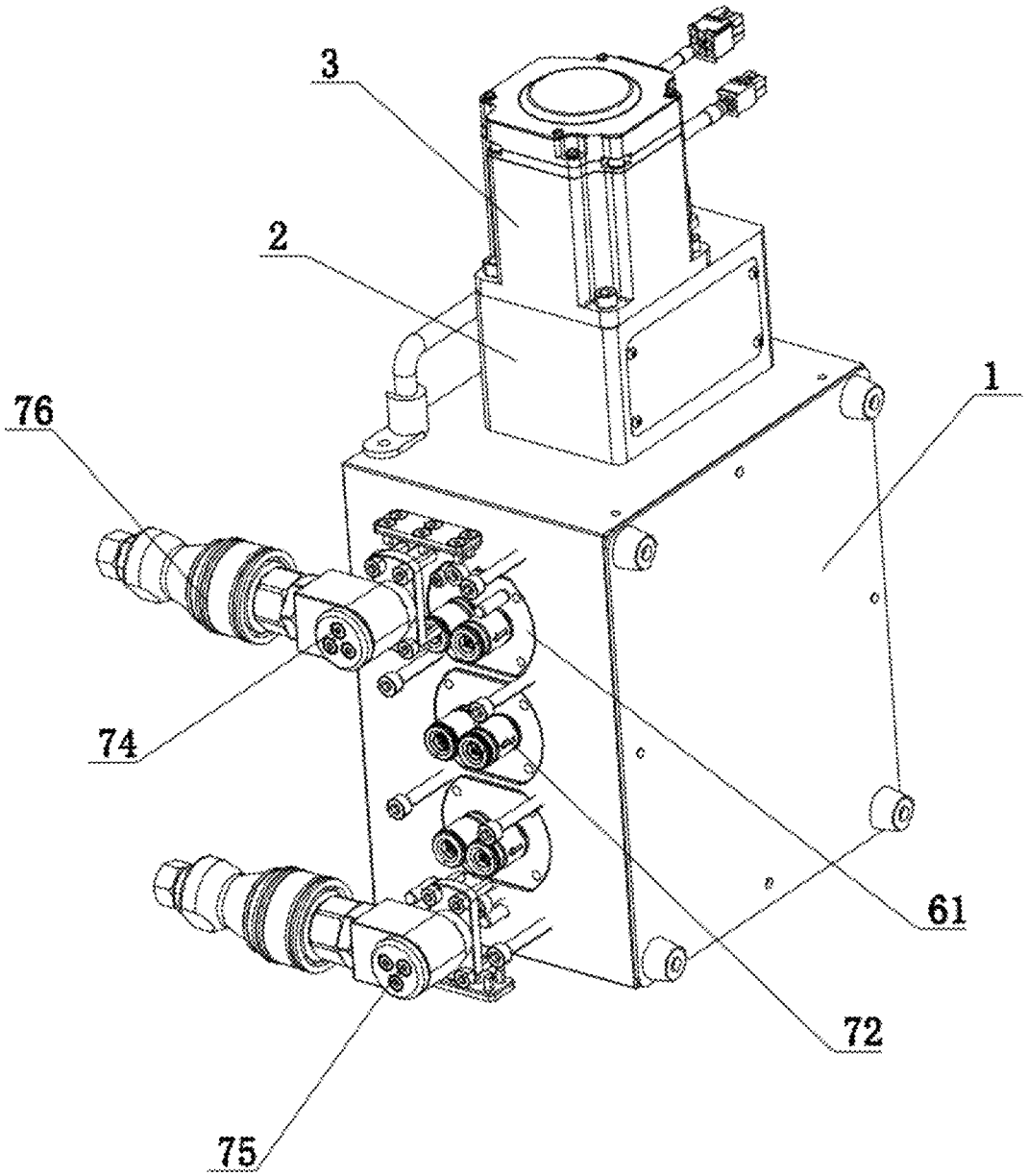
FIG. 7 is a schematic structural diagram in the present disclosure after a liquid storage tank is removed.
Figure 8:
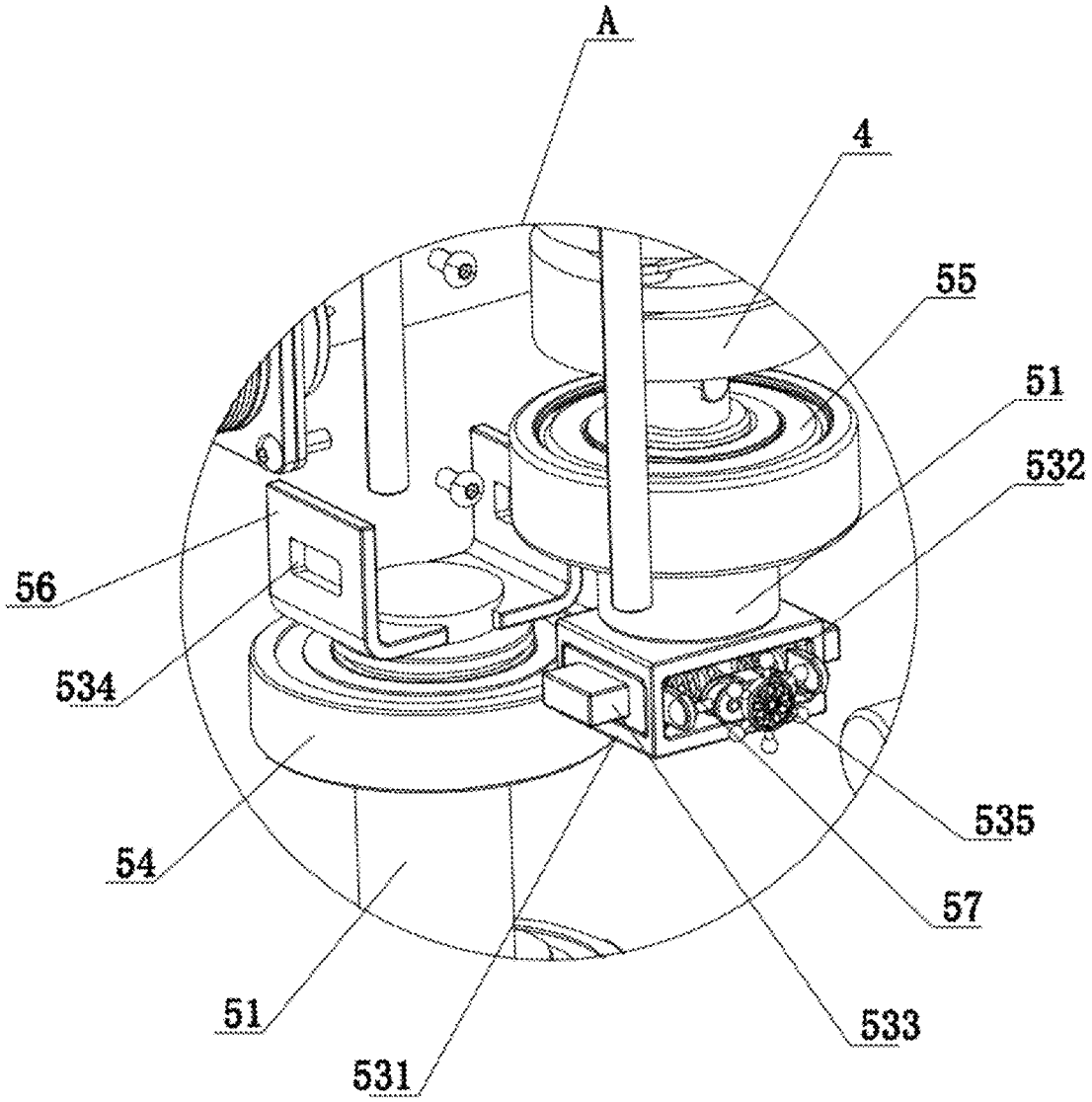
FIG. 8 is a schematic diagram of an enlarged structure at A of FIG. 6 in the present disclosure.
Figure 9:
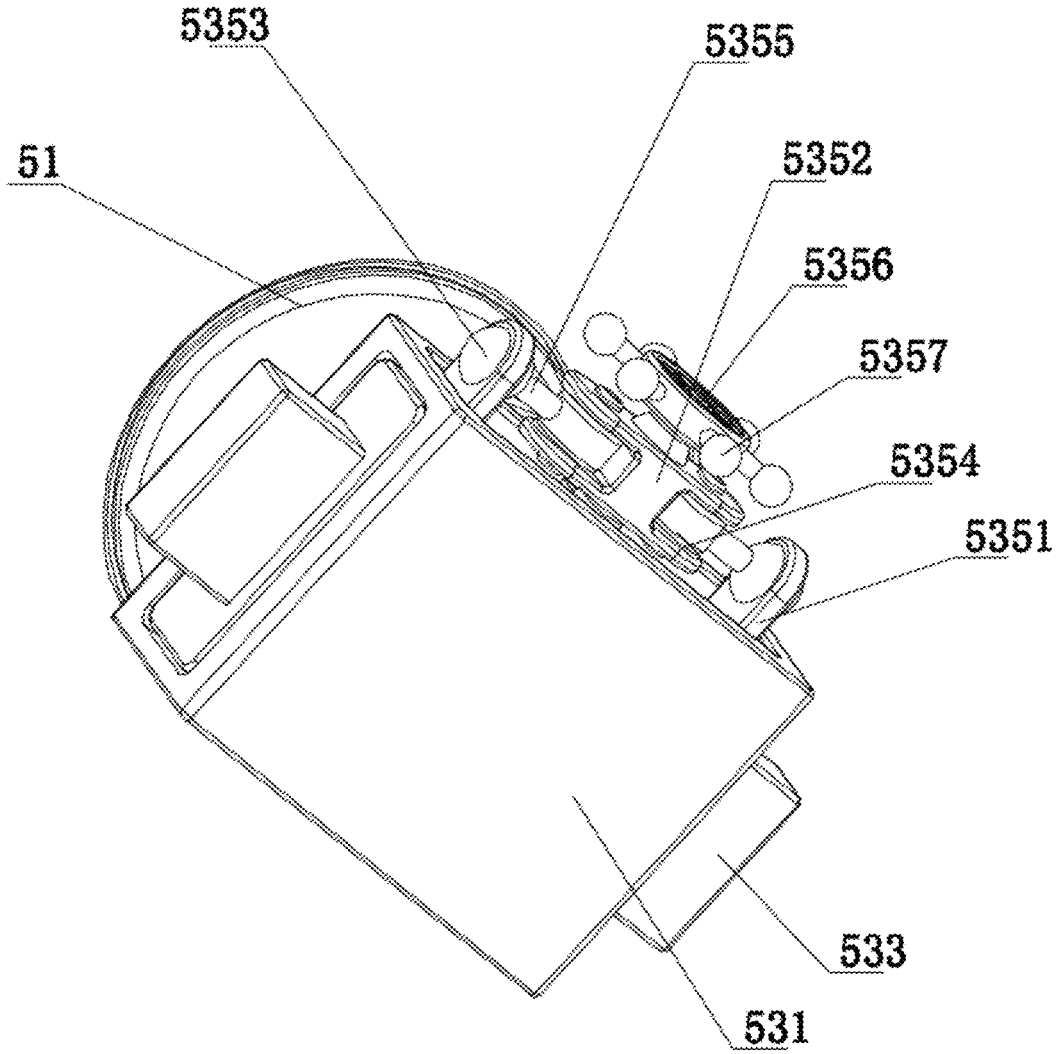
FIG. 9 is a bottom view structural schematic diagram of an adjusting assembly in the present disclosure.
Figure 10:
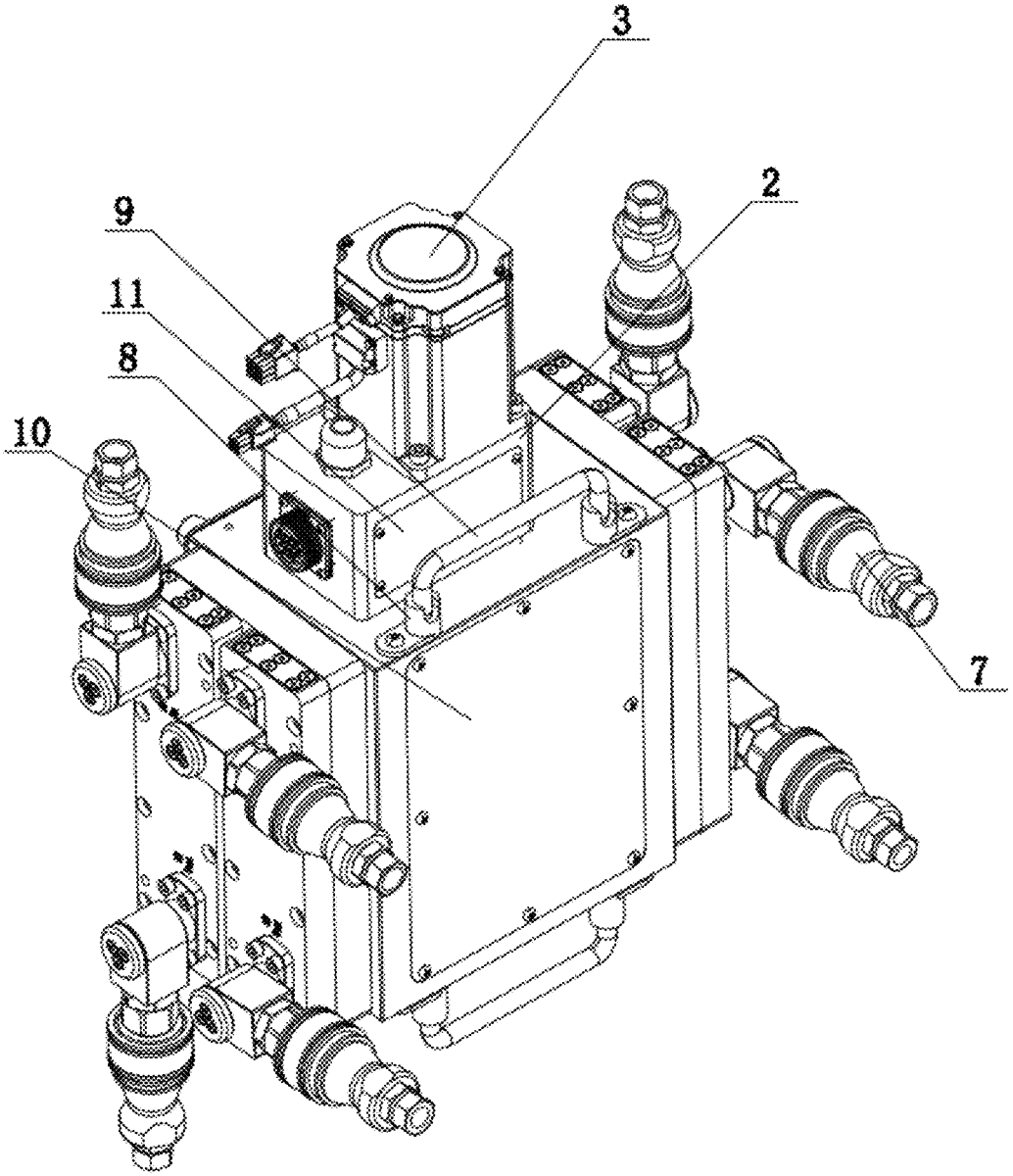
FIG. 10 is a schematic structural diagram in a one-drive-four state in the present disclosure.
Figure 11:
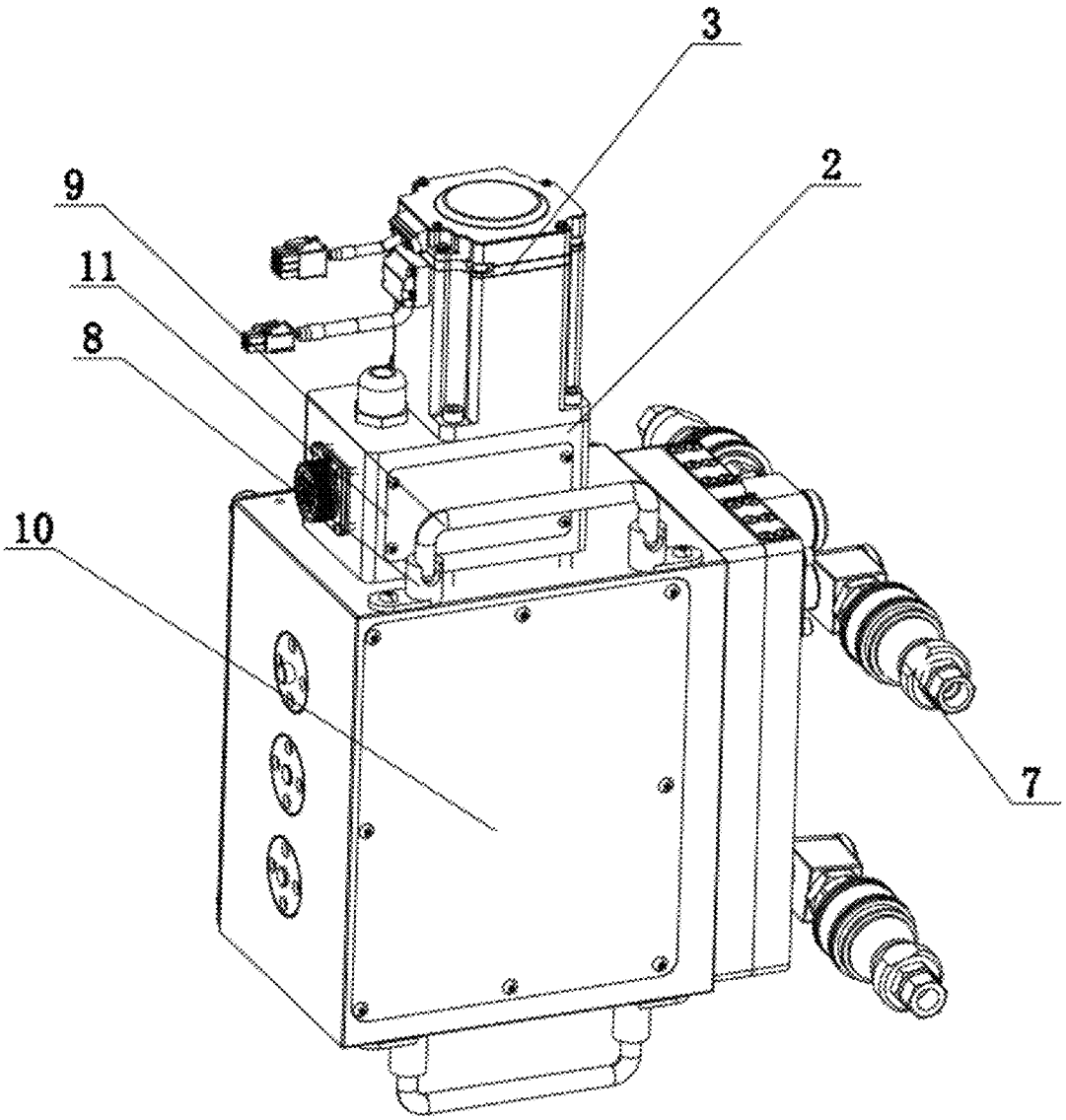
FIG. 11 is a schematic structural diagram in a one-drive-two state in the present disclosure.

Referring to FIGS. 1-11, in an embodiment of the present disclosure, a constant flow pump includes a constant flow pump case 1, where a motor support base 2 is fixedly mounted at a top of the constant flow pump case 1, a drive motor 3 is fixedly mounted at a top of the motor support base 2, an output end of the drive motor 3 penetrates through the motor support base 2, a coupling 4 is arranged in the motor support base 2, a cam shaft mechanism 5 is movably mounted in the constant flow pump case 1, a top of the cam shaft mechanism 5 is fixedly connected to a bottom output end of the drive motor 3 through the coupling 4, a piston mechanism 6 is movably mounted on an outer side of the cam shaft mechanism 5, the piston mechanism 6 coats the outer side of the cam shaft mechanism 5, a bearing is externally embedded onto each of the eccentric cams 54 of the cam shaft mechanism 5 and the cam shaft mechanism is connected to one or more piston mechanisms 6 to achieve one or more liquid injections simultaneously, the piston mechanism 6 is in transmission connection to the cam shaft mechanism 5, one end of the piston mechanism 6 penetrates through the constant flow pump case 1, and a liquid inlet and outlet mechanism 7 is fixedly mounted on a side of the constant flow pump case 1 away from the side penetrated by the piston mechanism 6. The drive motor 3 is stably mounted through the motor support base 2, so that the stability of power output is ensured. By arranging the coupling 4, the effective connection between the drive motor 3 and the cam shaft mechanism 5 is achieved, so that the energy loss and error in the transmission process are reduced. Second, the transmission connection between the cam shaft mechanism 5 and the piston mechanism 6 is skillful in design. Rotation of the cam shaft mechanism 5 can precisely drive the piston mechanism 6 to reciprocate, so that efficient liquid conveyance is achieved. This transmission mode not only improves the liquid injection precision and stability, but also reduces the wear and prolongs the service life of the equipment. Further, the liquid inlet and outlet mechanism 7 is fixedly mounted, so that the liquid comes in and goes out orderly and controllably. The cooperative work with the piston mechanism 6 guarantees that the constant flow pump can convey the liquid continuously and stably, so that pulsation and energy fluctuation are reduced. In an actual application, for example, in a case that a medicine liquid needs to be precisely added in a medicine manufacturing process, this constant flow pump can ensure the adding accuracy and consistency of the medicine liquid; and in chemical industry production, for the conveyance of various chemical reagents, the stable performance of the constant flow pump can guarantee smooth production and improve the product quality. The diameter of the piston cylinder 63 in the constant flow pump is not limited to the following: 20-30-40-50-60-70-80.

Referring to FIGS. 1-5 and FIG. 8, the liquid inlet and outlet mechanism 7 includes a liquid storage tank 71, the liquid storage tank 71 is fixedly mounted on the side of the constant flow pump case 1 away from the side penetrated by the piston mechanism 6, one-way valves 72 are fixedly mounted at an equal or unequal interval in the liquid storage tank 71, a busbar 73 is fixedly mounted on an outer side of the liquid storage tank 71, a liquid inlet pipe 74 is fixedly mounted at an upper end of an outer side of the busbar 73, a liquid outlet pipe 75 is fixedly mounted at a lower end of the outer side of the busbar 73, outer ends of the liquid inlet pipe 74 and the liquid outlet pipe 75 both are fixedly connected to self-closed rapid hydraulic joints 76, an output end of the liquid inlet pipe 74 communicates with an input end of the liquid storage tank 71 through the one-way valves 72, and the liquid outlet pipe 75 communicates with an output end of the liquid storage tank 71 through the one-way valves 72. The arrangement of the liquid storage tank 71 provides storage space for the liquid. The one-way valves 72 mounted at an equal interval inside the liquid storage tank ensure one-way flowing of the liquid in the liquid storage tank 71 to prevent backflow, so that the flowing directivity and stability are guaranteed. By designing the busbar 73, centralized connection and management of the liquid inlet pipe 74 and the liquid outlet pipe 75 are achieved, so that the liquid is inputted and outputted more orderly and efficiently. The self-closed rapid hydraulic joints 76 at the outer ends of the liquid inlet pipe 74 and the liquid outlet pipe 75 are conveniently connected to and detached from an external pipeline rapidly, so that the operating convenience and efficiency are improved. In an actual application, for example, in a large-scale industrial production line, this liquid inlet and outlet mechanism 7 can be connected to upstream and downstream equipment rapidly to achieve efficient liquid transmission. When the liquid type needs to be replaced or the equipment needs to be maintained, the self-closed rapid hydraulic joints 76 can break the connection rapidly, so that the liquid leakage is reduced and the operating time is shortened. The presence of the one-way valves 72 ensures the flowing unidirectionality of the liquid, so that the flow instability and production difficulties that may be caused by backflow are avoided.

Referring to FIGS. 1-5, permanent seats 8 are fixedly mounted at both ends of front sides of the top and a bottom of the constant flow pump case 1, and bridge handrails 9 are articulated in the permanent seats 8. A first overhaul sealed door 10 is mounted on a front surface of the constant flow pump case 1 through bolts, and a second overhaul sealed door 11 is mounted on a front surface of the motor support base 2 through bolts. The permanent seats 8 fixedly mounted at both ends of the front sides of the top and the bottom of the constant flow pump case 1 provide a stable mounting basis for the bridge handrails 9. Based on the articulated design, the bridge handrails 9 can rotate flexibly. When it is needed to carry or move the constant flow pump, the handrails are unfolded for easy operation, and the handrails are folded to save space when they are not used. The first overhaul sealed door 10 is mounted on the front surface of the constant flow pump case 1 through bolts, so that it is convenient to inspect, repair, and maintain components in the constant flow pump case 1. The second overhaul sealed door 11 is mounted on the front surface of the motor support base 2, so that the drive motor 3 is overhauled conveniently. In an actual scene, for example, when the equipment is maintained, a worker can open the first overhaul sealed door 10 and the second overhaul sealed door 11 in a relaxed manner to position and handle possible problems rapidly, so that the maintenance efficiency is improved. The sealed design can further prevent impurities such as dust and water vapor from entering side the constant flow pump case 1 effectively, so that the normal operation and service life of the constant flow pump are guaranteed.

Referring to FIGS. 3-6, the cam shaft mechanism 5 includes mounting seats 51 and a rotating shaft 52, the mounting seats 51 are provided in two groups, one of the mounting seats 51 is rotationally connected to a middle of the top in the constant flow pump case 1, the mounting seat 51 located at a top is fixedly connected to the output end of the drive motor 3 through the coupling 4, the mounting seat 51 located at a bottom is rotationally connected to a bottom in the constant flow pump case 1, clamping pieces 53 are fixedly mounted at both ends of the rotating shaft 52, the rotating shaft 52 is mounted between inner sides of the mounting seat 51 through the clamping pieces 53, eccentric cams 54 are fixedly mounted at an equal interval on an outer surface of the rotating shaft 52, and the piston mechanism 6 is sleeved on an outer side of each of the eccentric cams 54, each of the eccentric cams 54 is embedded onto the bearing, and the bearing is in contact with the piston mechanism 6. The mounting seats 51 are respectively arranged at the top and the bottom of the constant flow pump case 1 and are stably and rotationally connected to the constant flow pump case 1 to provide a reliable supporting and stable rotating basis for the rotating shaft 52. The clamping pieces 53 at both ends of the rotating shaft 52 enable the rotating shaft 52 to be conveniently mounted on an inner side of the mounting seat 51, which not only guarantees the mounting stability, but also facilitates detachment and replacement. The eccentric cams 54 that are fixedly mounted at an equal interval match with the piston mechanism 6 to precisely control movement of the piston mechanism 6, so that efficient and stable liquid conveyance is achieved. In an actual application, for example, in an industrial flow requiring high-precision flow control, this precise design can ensure the accuracy and consistency of liquid conveyance. When it is needed to maintain or replace the rotating shaft 52 or the eccentric cams 54, the design of the clamping pieces 53 makes the operation simple and convenient, so that the equipment downtime is shortened, and the production efficiency is improved.

Referring to FIGS. 4-7 and FIGS. 8-9, each of the clamping pieces 53 includes fixed arms 56 and a butting seat 531, the fixed arms 56 are fixedly mounted on both sides of a top and a bottom of the rotating shaft 52, the butting seat 531 is fixedly mounted on an inner side of each of the mounting seats 51, a cavity 532 is formed on an inner side of the butting seat 531, limiting springs 58 are fixedly connected at an equal interval on both sides in the cavity 532, a limiting bump 533 is fixedly connected to an outer side of each of the limiting springs 58, an outer end of the limiting bump 533 penetrates through the butting seat 531, a slot 534 is formed in an outer end of each of the fixed arms 56, the limiting bump 533 is inserted into the slot 534, and an adjusting assembly 535 is movably mounted on a front surface of the butting seat 531. The adjusting assembly 535 includes a connecting plate 5351 and an adjusting plate 5352, the adjusting plate 5352 is rotationally connected to a middle of the front surface of the butting seat 531, the connecting plate 5351 is fixedly mounted at an inner end of a front surface of the limiting bump 533, a front end of the connecting plate 5351 is rotationally connected to an articulating ball 5353, articulating grooves 5354 are formed in both ends of the adjusting plate 5352, a linkage rod 5355 is rotationally connected to an inner side of each of the articulating grooves 5354, an outer end of the linkage rod 5355 is fixedly connected to the articulating ball 5353, and an outer end of the linkage rod 5355 is articulated with the connecting plate 5351 through the articulating ball 5353. An adjusting hand wheel 5356 is fixedly mounted in a middle of a front surface of the adjusting plate 5352, handrail rods 5357 are fixedly mounted at an equal interval on an outer side of the adjusting hand wheel 5356, ball bearings 55 are movably mounted at the top and the bottom in the constant flow pump case 1, and an inner side of each of the ball bearings 55 is fixedly connected to each of the mounting seats 51. The fixed arms 56 match with the butting seat 531 to achieve the stable connection between the rotating shaft 52 and each of the mounting seats 51 through the interaction among the limiting spring 58, the limiting bump 533, and the slot 534, so that the positional stability of the rotating shaft 52 in the operating process is ensured, and the precision deviation and faults caused by looseness are reduced. The components in the adjusting assembly 535 such as the adjusting plate 5352, the connecting plate 5351, and the linkage rod 5355 work cooperatively. The adjusting hand wheel 5356 is rotated to drive the adjusting plate 5352. Through the transmission of the linkage rod 5355 and the articulating ball 5353, the connecting plate 5351 drives the limiting bump 533 to move, so as to rapidly detach and mount the clamping pieces 53, so that the component maintenance and replacement efficiency is greatly improved. By arranging the handrail rods 5357, it is convenient to operate the adjusting hand wheel 5356. The ball bearings 55 are mounted to reduce the frictional force of the mounting seats 51 during rotation, so that the operating efficiency and stability of the overall mechanism are improved. In an actual application, for example, it is needed to replace the rotating shaft 52 emergently in a production line, based on this convenient clamping and adjusting design, the replacement operation can be rapidly accomplished, so that the downtime is shortened and the production efficiency is improved. The presence of the ball bearings 55 reduces the energy consumption and prolongs the service life of the equipment.

Referring to FIGS. 3-6, the piston mechanism 6 includes pump cores 61 and piston frames 62, the piston frames 62 are arranged at an equal interval in the constant flow pump case 1, the piston frames 62 are sleeved on outer sides of the eccentric cams 54 on the outer surface of the rotating shaft 52, a piston cylinder 63 is mounted on a side, close to a liquid storage tank 71, of each of the piston frames 62 through bolts, the pump cores 61 are fixedly mounted at an equal interval in the liquid storage tank 71, an outer side of each of the pump cores 61 communicates with each of the one-way valves 72, an end of the piston cylinder 63 is inserted into each of the pump cores 61, and the piston cylinder 63 is used for driving each of the pump cores 61. A guiding shaft 64 is mounted on a side, away from the piston cylinder 63, of each of the piston frames 62 through bolts, and an end of the guiding shaft 64 penetrates through the constant flow pump case 1. The piston frames 62 that are arranged at an equal interval are sleeved on the outer sides of the eccentric cams 54 on the outer surface of the rotating shaft 52, so that the rotation of the eccentric cams 54 can precisely drive the piston frames 62 to move, so as to achieve efficient liquid pumping. The piston cylinder 63 and the guiding shaft 64 mounted through bolt not only guarantee the connecting stability, but also facilitate detachment and replacement as needed, so that the maintenance cost and difficulty are reduced. The pump cores 61 are fixedly mounted in the liquid storage tank 71 and communicate with the one-way valves 72. The piston cylinder 63 can effectively drive the pump cores 61 to work to ensure stable conveyance of the liquid. In an actual application, for example, when a high-viscosity liquid is pumped in chemical industry production, these stable and highly maintainable piston mechanisms 6 can work continuously and reliably. When a certain piston fails, the corresponding piston cylinder 63 or guiding shaft 64 can be rapidly detached for maintenance or replacement without affecting the operation of the whole constant flow pump, so that production continuity is guaranteed.

The working principle of the present disclosure is as follows: by arranging the drive motor 3 and the cam shaft mechanism 5 that match with each other, the apparatus can operate by starting the drive motor 3 in the using process; the drive motor 3 will drive the rotating shaft 52 to rotate during work, and the rotating shaft 52 rotates to drive each of the eccentric cams 54 to rotate therewith; with the rotation of each of the eccentric cams 54, each of the piston frames 62 can be promoted to reciprocate horizontally in the constant flow pump case 1; in the meanwhile, thanks to an assisted guiding action of the guiding shaft 64, the piston frame 62 can be promoted to stably twitch the piston cylinder 63 to reciprocate horizontally; twitching by the piston cylinder 63 will drive the pump core 61 to operate, so as to form one-way circulation of the liquid through the one-way valve 72; previously, the self-closed rapid hydraulic joints 76 at the outer ends of the liquid inlet pipe 74 and the liquid outlet pipe 75 are connected to the pipeline in an assisted manner, the liquid enters into the liquid storage tank 71 through the liquid inlet pipe 74, and is then conveyed to the liquid outlet pipe 75 to be discharged as the piston mechanism 6 and the valve core match. In the present disclosure, the rotating shaft 52 and the eccentric cams 54 are machined to form an integrated structure, which greatly reduces the manual assembly error generated during split assembly, so that higher precision is achieved. Moreover, based on this integrated design, the rotating shaft 52 and each of the eccentric cams 54 are not independently assembled, so that the assembly difficulty and the debugging complexity are significantly reduced. The higher assembly precision means that the constant flow pump can possess higher stability and liquid injection precision during operation, and can further effectively reduce the wear problem. The cam shaft mechanism 5 is connected to the plurality of piston mechanisms 6 to achieve one or more liquid injections simultaneously. The liquid inlet pipe 74 and the liquid outlet pipe 75 of a liquid storage cavity both are provided with the one-way valves 72 and are connected to a bus board, so that the liquid only can flow unidirectionally, pulsation is greatly reduced, and the liquid injection precision is significantly improved. For example, in a process of injecting high-precision chemical reagents, this high-precision and low-pulsation liquid injection mode can ensure the accurate addition of the regents to prevent an experimental result from being affected by flow fluctuation.

By arranging the clamping pieces 53, during application of the apparatus, when it is needed to overhaul the cam shaft mechanism 5 in the apparatus, as the guiding shaft 64 and the piston cylinder 63 on both sides of each of the piston frame 62 in the piston mechanism 6 can be detached through bolts, the guiding shaft 64 and the piston cylinder 63 can be removed at this time; then, by manually pressing against the handrail rod 5357 and twisting the adjusting hand wheel 5356 to rotate, the adjusting hand wheel 5356 rotates to drive the linkage rod 5355 to move, the linkage rod 5355 is articulated to the inner side of the articulating groove 5354, and the end of the linkage rod is articulated with the connecting plate 5351 through the articulating ball 5353. As the adjusting hand wheel 5356 drives the adjusting plate 5352 to rotate, the adjusting plate 5352 can pull the linkage rod 5355 to drive the connecting plate 5351 to move inward, and the connecting plate 5351 moves inward to drive the limiting bump 533 to move toward the inner side. When the limiting bump 533 is separated from the slot 534, the slot 534 is separated from the limiting bump 533, so that the butting seat 531 can be extracted from the inner sides of the two fixed arms 56. In this case, the butting seat 531 can be taken out from the inner sides of the mounting seats 51 rapidly, so that the rotating shaft 52 and each of the eccentric cams 54 are detached rapidly. When the rotating shaft and the eccentric cams need to be mounted, it is only needed to insert a butting seat 531 with the new rotating shaft 52 and eccentric cams 54 into the inner sides of the mounting seats 51, and in this case, the limiting bump 533 is in contact with the interior of the slot 534. After the adjusting hand wheel 5356 is loosened, the limiting spring 58 is reset to drive the limiting bump 533 to move outward to be inserted into the slot 534. By clamping the limiting bump 533 and the slot 534 in a limited manner, the butting seat 531 and a connecting base can be clamped. It can be seen that in the overall apparatus, the rotating shaft 52 and eccentric cams 54 can be rapidly dismounted. With the adoption of the clamping design of the clamping pieces 53, during overhauling, the rotating shaft 52 and each of the eccentric cams 54 both can be removed from the output end of the drive motor 3 in the constant flow pump case 1 without integrally dismounting a whole structure of the drive motor 3. During overhauling and maintenance, the rotating shaft 52 and eccentric cams 54 can be rapidly dismounted and overhauled, so that the overall apparatus is conveniently and flexibly dismounted, overhauled, and maintained, and the assembling, using, and subsequent maintaining convenience of the overall apparatus are significantly improved. For example, during emergency overhauling of faults of the constant flow pump in industrial production, based on the conveniently dismounting design, the maintenance time can be greatly shortened and the production downtime loss can be greatly reduced.

What is claimed is:

1. A constant flow pump, comprising a constant flow pump case (1), wherein a motor support base (2) is fixedly mounted at a top of the constant flow pump case (1), a drive motor (3) is fixedly mounted at a top of the motor support base (2), an output end of the drive motor (3) penetrates through the motor support base (2), a coupling (4) is arranged in the motor support base (2), a cam shaft mechanism (5) is movably mounted in the constant flow pump case (1), a top of the cam shaft mechanism (5) is fixedly connected to a bottom output end of the drive motor (3) through the coupling (4), a piston mechanism (6) is movably mounted on an outer side of the cam shaft mechanism (5), the piston mechanism (6) coats the outer side of the cam shaft mechanism (5), the piston mechanism (6) is in transmission connection to the cam shaft mechanism (5), one end of the piston mechanism (6) penetrates through the constant flow pump case (1), and a liquid inlet and outlet mechanism (7) is fixedly mounted on a side of the constant flow pump case (1) away from the side penetrated by the piston mechanism (6).

2. The constant flow pump according to claim 1, wherein the liquid inlet and outlet mechanism (7) comprises a liquid storage tank (71), the liquid storage tank (71) is fixedly mounted on the side of the constant flow pump case (1) away from the side penetrated by the piston mechanism (6), a one-way valve (72) is fixedly mounted in the liquid storage tank (71), a busbar (73) is fixedly mounted on an outer side of the liquid storage tank (71), a liquid inlet pipe (74) is fixedly mounted at an upper end of an outer side of the busbar (73), a liquid outlet pipe (75) is fixedly mounted at a lower end of the outer side of the busbar (73), outer ends of the liquid inlet pipe (74) and the liquid outlet pipe (75)

both are fixedly connected to self-closed rapid hydraulic joints (76), an output end of the liquid inlet pipe (74) communicates with an input end of the liquid storage tank (71) through the one-way valve (72), and the liquid outlet pipe (75) communicates with an output end of the liquid storage tank (71) through the one-way valve (72).

3. The constant flow pump according to claim 1, wherein permanent seats (8) are fixedly mounted at both ends of front sides of the top and a bottom of the constant flow pump case (1), and bridge handrails (9) are articulated in the permanent seats (8).

4. The constant flow pump according to claim 1, wherein a first overhaul sealed door (10) is mounted on a front surface of the constant flow pump case (1) through bolts, and a second overhaul sealed door (11) is mounted on a front surface of the motor support base (2) through bolts.

5. The constant flow pump according to claim 1, wherein the cam shaft mechanism (5) comprises mounting seats (51) and a rotating shaft (52), the mounting seats (51) are provided in two groups, one of the mounting seats (51) is rotationally connected to a middle of the top in the constant flow pump case (1), the mounting seat (51) located at a top is fixedly connected to the output end of the drive motor (3) through the coupling (4), the mounting seat (51) located at a bottom is rotationally connected to a bottom in the constant flow pump case (1), clamping pieces (53) are fixedly mounted at both ends of the rotating shaft (52), the rotating shaft (52) is mounted between inner sides of the mounting seat (51) through the clamping pieces (53), eccentric cams (54) are fixedly mounted at an equal interval on an outer surface of the rotating shaft (52), and the piston mechanism (6) is sleeved on an outer side of each of the eccentric cams (54).

6. The constant flow pump according to claim 5, wherein each of the clamping pieces (53) comprises fixed arms (56) and a butting seat (531), the fixed arms (56) are fixedly mounted on both sides of a top and a bottom of the rotating shaft (52), the butting seat (531) is fixedly mounted on an inner side of each of the mounting seats (51), a cavity (532) is formed on an inner side of the butting seat (531), limiting springs (58) are fixedly connected at an equal interval on both sides in the cavity (532), a limiting bump (533) is fixedly connected to an outer side of each of the limiting springs (58), an outer end of the limiting bump (533) penetrates through the butting seat (531), a slot (534) is formed in an outer end of each of the fixed arms (56), the limiting bump (533) is inserted into the slot (534), and an adjusting assembly (535) is movably mounted on a front surface of the butting seat (531).

7. The constant flow pump according to claim 6, wherein the adjusting assembly (535) comprises a connecting plate (5351) and an adjusting plate (5352), the adjusting plate (5352) is rotationally connected to a middle of the front surface of the butting seat (531), the connecting plate (5351) is fixedly mounted at an inner end of a front surface of the limiting bump (533), a front end of the connecting plate (5351) is rotationally connected to an articulating ball (5353), articulating grooves (5354) are formed in both ends of the adjusting plate (5352), a linkage rod (5355) is rotationally connected to an inner side of each of the articulating grooves (5354), an outer end of the linkage rod (5355) is fixedly connected to the articulating ball (5353), and an outer end of the linkage rod (5355) is articulated with the connecting plate (5351) through the articulating ball (5353).

8. The constant flow pump according to claim 7, wherein an adjusting hand wheel (5356) is fixedly mounted in a middle of a front surface of the adjusting plate (5352), handrail rods (5357) are fixedly mounted at an equal interval on an outer side of the adjusting hand wheel (5356), ball bearings (55) are movably mounted at the top and the bottom in the constant flow pump case (1), and an inner side of each of the ball bearings (55) is fixedly connected to each of the mounting seats (51).

9. The constant flow pump according to claim 1, wherein the piston mechanism (6) comprises pump cores (61) and piston frames (62), the piston frames (62) are arranged at an equal interval in the constant flow pump case (1), the piston frames (62) are sleeved on outer sides of eccentric cams (54) on outer surface of rotating shaft (52), a piston cylinder (63) is mounted on a side, close to a liquid storage tank (71), of each of the piston frames (62) through bolts, the pump cores (61) are fixedly mounted at an equal interval in the liquid storage tank (71), an outer side of each of the pump cores (61) communicates with each of the one-way valves (72), an end of the piston cylinder (63) is inserted into each of the pump cores (61), and the piston cylinder (63) is used for driving each of the pump cores (61).

10. The constant flow pump according to claim 9, wherein a guiding shaft (64) is mounted on a side, away from the piston cylinder (63), of each of the piston frames (62) through bolts, and an end of the guiding shaft (64) penetrates through the constant flow pump case (1).

* * * * *